US008988219B2

(12) United States Patent
McCloskey

(10) Patent No.: US 8,988,219 B2
(45) Date of Patent: Mar. 24, 2015

(54) ALERT SYSTEM BASED ON CAMERA IDENTIFICATION

(75) Inventor: Scott McCloskey, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1075 days.

(21) Appl. No.: 12/257,969

(22) Filed: Oct. 24, 2008

(65) Prior Publication Data

US 2010/0102961 A1 Apr. 29, 2010

(51) Int. Cl.

| | |
|---|---|
| ***G08B 21/00*** | (2006.01) |
| ***G08B 29/04*** | (2006.01) |
| ***G08B 13/196*** | (2006.01) |

(52) U.S. Cl.

CPC ..... *G08B 29/046* (2013.01); *G08B 13/196* (2013.01)

USPC ..... 340/540; 340/500

(58) Field of Classification Search

USPC ..... 340/500, 540; 382/100; 348/207.99

See application file for complete search history.

(56) References Cited

U.S. PATENT DOCUMENTS

| | | | | |
|---|---|---|---|---|
| 5,499,294 | A * | 3/1996 | Friedman | 713/179 |
| 5,898,779 | A * | 4/1999 | Squilla et al. | 713/176 |
| 6,005,936 | A * | 12/1999 | Shimizu et al. | 713/176 |
| 6,026,193 | A * | 2/2000 | Rhoads | 382/232 |
| 6,167,469 | A * | 12/2000 | Safai et al. | 710/62 |
| 6,507,371 | B1 * | 1/2003 | Hashimoto et al. | 348/552 |
| 6,670,933 | B1 * | 12/2003 | Yamazaki | 345/1.1 |
| 6,831,990 | B2 * | 12/2004 | Marvel et al. | 382/100 |
| 7,120,274 | B2 * | 10/2006 | Kacker et al. | 382/100 |
| 7,129,973 | B2 | 10/2006 | Raynor | |
| 7,454,061 | B2 * | 11/2008 | Yanagisawa et al. | 382/181 |
| 7,587,514 | B2 * | 9/2009 | Anderson | 709/235 |
| 2003/0123701 | A1 * | 7/2003 | Dorrell et al. | 382/100 |
| 2004/0017925 | A1 * | 1/2004 | Marvel et al. | 382/100 |
| 2008/0219495 | A1 * | 9/2008 | Hulten et al. | 382/100 |
| 2008/0259203 | A1 * | 10/2008 | Goris et al. | 348/362 |
| 2008/0285890 | A1 * | 11/2008 | Han et al. | 382/305 |

* cited by examiner

*Primary Examiner* — James Yang

(74) *Attorney, Agent, or Firm* — Schwegman Lundberg & Woessner, P.A.

(57) ABSTRACT

Some embodiments of the application provides methods and systems for receiving image frames from a plurality of repositories, extracting a camera fingerprint for each of the image frames, storing the camera fingerprints in a directory, receiving a new image frame from one of the plurality of repositories and extracting a new camera fingerprint corresponding to the new image frame, comparing the new camera fingerprint to each of the stored camera fingerprint, and generating an alert if a match is determined between the new camera fingerprint and at least one of the stored camera fingerprints in the directory.

20 Claims, 5 Drawing Sheets

250

| 252 CAMERA ID | 254 ANALYST ID | 256 INVESTIGATION ID | 258 MATCH THRESHOLD |
|---|---|---|---|
| CAMERA 001 | ANALYST 2 | INVESTIGATION I1 | A |
| | | INVESTIGATION I3 | B |
| | ANALYST 5 | INVESTIGATION I7 | C |
| ⋮ | ⋮ | ⋮ | ⋮ |
| CAMERA 394 | ANALYST 8 | INVESTIGATION I32 | N |

ALERT SYSTEM BASED ON CAMERA IDENTIFICATION

TECHNICAL FIELD

The present application relates generally to camera identification and in particular to an alert system based on camera identification.

BRIEF DESCRIPTION OF THE DRAWINGS

Some embodiments are illustrated by way of examples, and not by way of limitations, in the figures of the accompanying drawings in which.

DETAILED DESCRIPTION

Figure 1A:
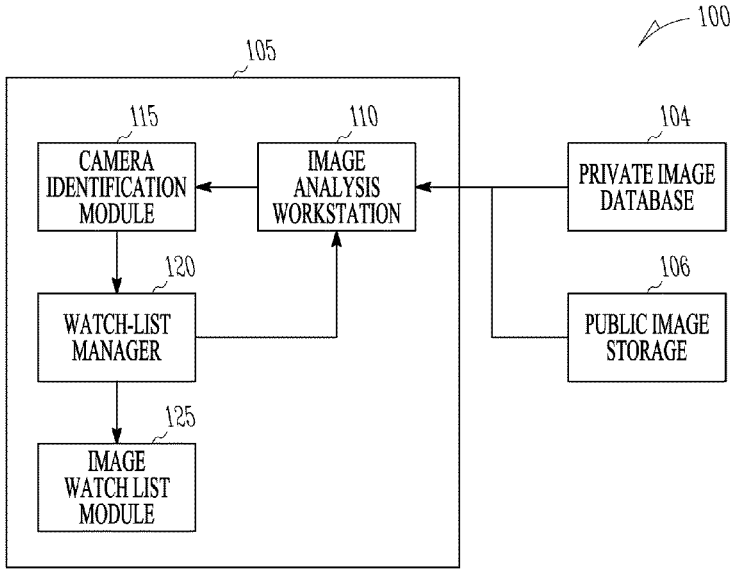
FIG. 1A is a block diagram of a system to generate an image watch-list entry, according to an example embodiment.

In the following description, for purposes of explanation, numerous specific details are set forth in order to provide a thorough understanding of example embodiments. The following detailed description includes reference to the accompanying drawings, by way of illustration, specific embodiments in which the invention may be practiced. The embodiments may be combined, other embodiments may be utilized, or structural, logical and electrical changes may be made without departing from the scope of the present invention. The following detailed description is, therefore not to be taken in the limiting sense, and the scope of the present invention is defined by the appended claims and their equivalents. It will be evident, however, to one skilled in the art that the embodiments of the application may be practiced without these specific details.

In this document, the terms "a" or "an" are used, as is common in patent documents, to include one or more than one. In this document, the term "or" is used to refer to a nonexclusive or, unless otherwise indicated.

The functions or algorithms described herein may be implemented in software or a combination of software, hardware and human implemented procedures in one embodiment. The software may consist of computer executable instructions stored on computer readable media such as memory or other type of storage devices. The term "computer readable media" is also used to represent any means by which the computer readable instructions may be received by the computer, such as by different forms of wired or wireless transmissions. Further, such functions correspond to modules, which are software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, server or other computer system.

System and methods are provided herein to identify objectionable content among images and videos uploaded to public repositories using the internet. Digital cameras have electronic sensors that include a number of pixels, typically ranging from 100,000 pixels for WebCam or low-quality TV to 16 mega-pixels for a high-end digital still camera. Camera sensors (for example, charge coupled devices (CCD) or complementary metal-oxide-semiconductors (CMOS) chips) have material and manufacturing imperfections that are unique, and fingerprints based on these imperfections can be used to discriminate between data coming from two cameras of the same make and model. Due to material properties and the various manufacturing processes that each camera sensor undergoes, each camera sensor includes pixels at particular locations that are imperfect when compared to the remaining pixels. Once a camera sensor has been manufactured, it is impossible to alter the location of imperfect pixels at unique locations without overtly damaging the pixels of the camera sensors. Various fingerprints can be generated based on distinct locations of imperfect pixels. Additional fingerprint types that may be generated can include those that characterize other components of the imaging system, including optics and color filter arrays. In some embodiments, the generated fingerprint can be used to identify a particular camera sensor for its authenticity when video images from the camera sensor are received by a camera identification system that is described herein. Examples of camera sensor fingerprinting discussed herein are described in U.S. patent application Ser. No. 12/099,591, entitled "METHOD AND SYSTEM FOR CAMERA SENSOR FINGERPRINTING," filed on Apr. 8, 2008, and assigned to Honeywell International, Inc., which is incorporated herein by reference in its entirety. In various examples, the use of the term "fingerprint" may be used interchangeably with "signature." In some examples, camera fingerprint includes among other things information regarding at least one of a sensor fingerprint, a lens distortion estimate, and a color filter array marker. In one example, the lens distortion estimate provides a measure of the level of distortion introduced onto an image by a camera lens. Typically, lens distortion is usually found at the same location for all images taken by a camera using the same lens that exhibits distortion. In one example, a color filter array marker may be used to provide a measure of a characteristic of a filter used in conjunction with a camera.

Public and Private image and video repositories can be used to disseminate image and video over the internet having objectionable content. There is a desire to identify objectionable content among images and videos uploaded to public repositories using the internet.

FIG. 1A is a block diagram of a system 100 to generate an image watch-list entry, according to an example embodiment. System 100 includes a watch-list enrollment system 105, a private image database 104, and a public image storage 106. In some embodiments, a watch-list enrollment system 105 includes an image analysis workstation 110, a camera identification system 115, a watch-list manager 120, and an image watch-list module 125. Image analysis workstation 110 is communicatively coupled to camera identification module 115 and the watch-list manager 120. The watch-list manager 120 is communicatively coupled to camera identification module 115 and image watch-list module 125.

Image analysis workstation 110 is configured to receive images from at least one of private database 104 and public image storage 106. In some embodiments, the image analysis workstation 110 performs analysis of incoming images using computer means to automatically determine whether the received images have objectionable content or relate to improper activity. In some embodiments, the image analysis workstation 110 includes analysts who manually determine if the received images include objectionable content or content related to the commission of a crime.

In some embodiments, public image storage 106 can include video repositories such as YouTube, Flickr, etc. Public image storage 106 can be often used to disseminate images relating to objectionable activity, some of which may be relevant to ongoing investigations. For example, video footage of insurgent attacks (for example, suicide attacks, car bombings, or road-side bombings using improvised explosive devices) on the public are often captured and posted to public sites such as YouTube for propaganda purposes, and intelligence agencies have a need to find such information in the course of their investigations. Similarly, other illegal acts such as child pornography, vandalism etc., are often captured using digital video cameras and uploaded to public websites. Due to the large volume of data posted to public image storage 106, investigators may not be able to detect all images that have objectionable content or are related to an ongoing investigation. Investigators often face a substantial delay or an inability (due to resource limitations) to identify content related to investigation. A substantial delay in identifying the images is incurred due to the sifting of images through large volumes of uploaded data.

Though most public image repositories offer users the ability to receive notification when a certain user submits new content, this feature is not useful in forensic settings where, presumably, the person posting the objectionable content can use different user IDs to prevent detection. Given this, there is a need for tools that can notify investigators when content related to ongoing investigations is uploaded to public repositories.

In certain cases, investigators may need to find posted images (such as a picture or a video) that originated from a camera previously used in the commission or documenting of a crime. Embodiments provided herein may be used to get such information in a timely manner by using an automated system to identify the computer or system used to upload the content while the person of interest may still be near the physical location of that computer or system.

The automated detection of content related to ongoing investigations can be performed by determining whether the newly-uploaded images were captured with a camera used to capture previously detected and/or investigated images. This can be achieved by extracting a sensor fingerprint or other identifying features from the previously identified image and comparing this to similar features extracted from newly posted content. A watch-list of cameras is developed to alert an analyst/investigator to new images that may have objectionable content or may be related to images under investigation due to the use of a particular camera. In order to add a camera to the watch-list, an analyst/investigator need only provide a video clip or set of images as input. The proposed system extracts the sensor fingerprint and other features from that video, and adds it to a watch-list of cameras.

In some embodiments, as images (stationary or video) are uploaded to the public repositories, camera fingerprints are extracted from the new content. These camera fingerprints are compared to those available in the watch-list and, when a match is determined, an alert is posted to the operator who initiated the watch-list entry or to other operators with a need to know. Such alerts would provide the operators with the location of the new video, as well as a link to the original video that the operator specified as being of interest.

Figure 1B:
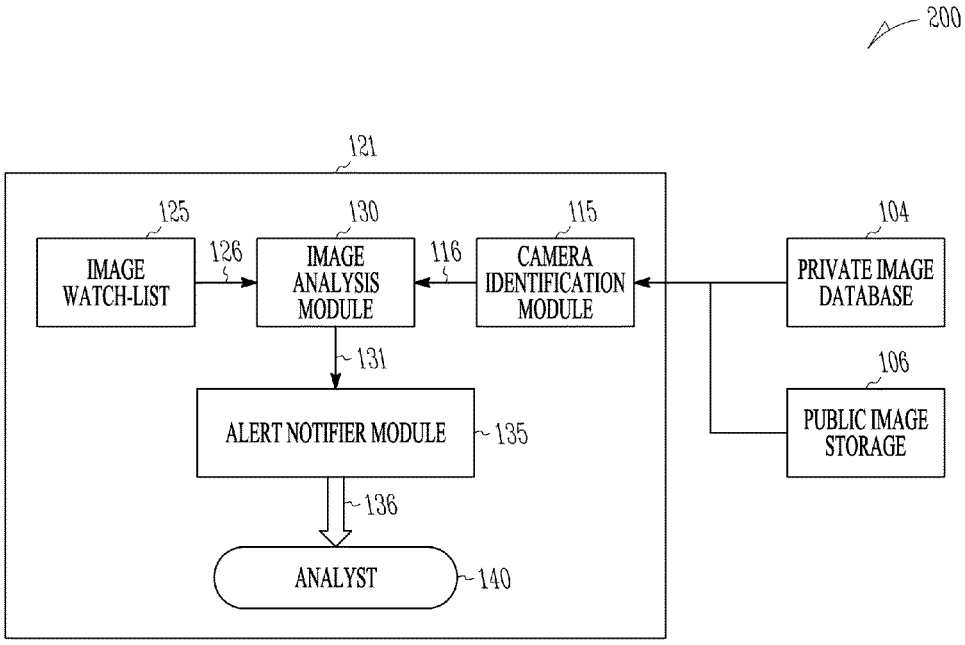
FIG. 1B is a block diagram of a system to provide alert notification to an analyst regarding a received image or video, according to an example embodiment.

FIG. 1B is a block diagram of a system 200 to provide alert notification to an analyst regarding a received image or video, according to an example embodiment. System 200 includes a private image database 104, a public image storage 106, and an image notification system 121. The image notification system 121 includes a camera identification module 115, an image analysis module 130, alert notifier module 135, and analyst 140. Camera identification module 115 is configured to receive new images from at least one of the private image database 104 and the public image storage 106. Image analysis module 130 is communicably coupled to the image watch-list module 125, the camera identification module 115 using, and the alert notifier module 135 using links 126, 116, and 131. Alert notifier module communicates with the analyst 140 using an email, text or a voice messaging system.

In some embodiments, image analysis module 130 includes a variable threshold set by the analyst at the time that a watch-list entry is generated. This threshold, which is associated with the watch-list entry, allows the analyst to specify how close a match is required to generate an alert.

Figures 2, 3A:
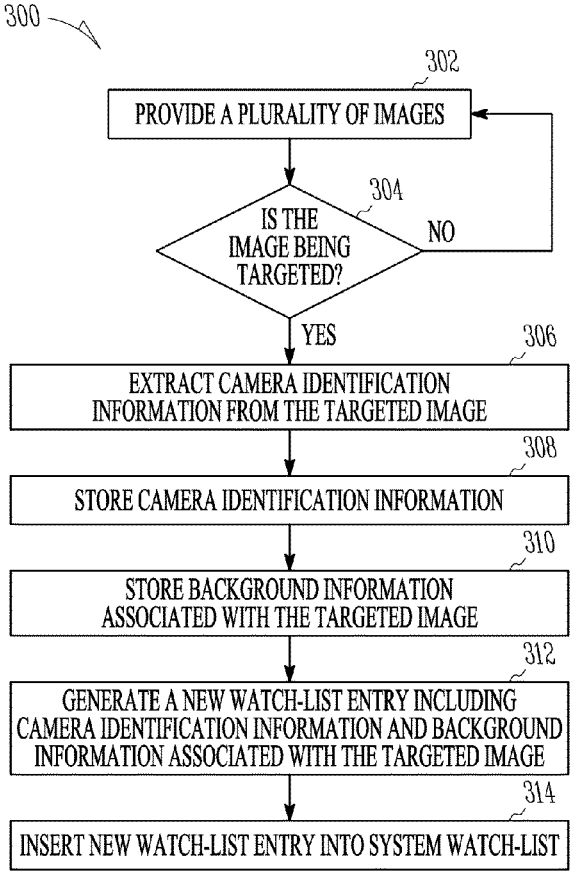
FIG. 2 is a watch-list used for camera identification, according to an example embodiment.
FIG. 3A is a flow chart of a method to generate a watch-list entry for camera identification, according to some embodiments of the invention.

FIG. 2 is a watch-list 250 used for camera identification, according to an example embodiment. In some embodiments, watch-list 250 includes a column 252 having entries that identify various cameras (e.g., CAMERA 001, CAMERA 394, etc.) and the associated sensor fingerprints and/or other identifying feature. In some embodiments, watch-list 250 includes a column 254 having entries that represent analysts (e.g., ANALYST 2, ANALYST 5, ANALYST 8, etc.). In some embodiments, watch-list 250 includes a column 256 having entries that represent investigation IDs (e.g., INVESTIGATION 11, INVESTIGATION 13, INVESTIGATION 17, INVESTIGATION 132, etc.) that may correspond to various analyst IDs in column camera IDs. In some embodiments, watch-list 250 includes a column 258 having entries that represent match threshold levels (A, B, C, N, etc.) that may correspond to various investigation IDs. In some embodiments, the analyst can configure the match threshold levels specified in column 258 to a particular confidence level. In some embodiments, the analyst can receive a higher or lower number of image matches based on the choice of the match threshold level.

FIG. 3A is a flow chart of a method 300 to generate a watch-list entry for camera identification, according to some embodiments of the invention.

At block 302, method 300 provides a plurality of images to image analysis workstation 110 (as shown in FIG. 1A). In some embodiments, the received images at image analysis workstation 110 are analyzed manually by human analysts or automatically using computer algorithms to determine if the image is related to an on-going investigation or whether an investigation should be initiated on the basis of that content. In various embodiments, method 300 proceeds to block 304 after the execution of the method step in block 302.

At block 304, method 300 determines whether a received image is either targeted, under an investigation, or of interest to an analyst. In some embodiments, if the image is determined that it is not being targeted, then method 300 proceeds to block 302. If the image is being targeted, method 300 proceeds to block 306. In various embodiments, method 300 proceeds to block 306 after the execution of the method step in block 304.

At block 306, method 300 extracts camera identification data from the targeted image. In some embodiments, the method of extraction of camera identification information is described in U.S. patent application Ser. No. 12/099,591, which is incorporated herein by reference in its entirety. In various embodiments, method 300 proceeds to block 308 after the execution of the method step in block 306.

At block 308, method 300 stores camera identification data associated with the received targeted image. In some embodiments, the camera identification data is stored in a directory in image watch-list module 125. In various embodiments, method 300 proceeds to block 310 after the execution of the method step in block 308.

At block 310, method 300 stores background information associated with the received targeted image. In some embodiments, the background information associated with the targeted image is stored in a database such as image watch-list module 125. In some embodiments, an analyst determines whether the reference camera identification data corresponding to a particular image frame is to be added to the directory. In various embodiments, method 300 proceeds to block 312 after the execution of the method step in block 310.

At block 312, method 300 generates a new watch-list entry including camera identification (such as fingerprint) data and background information associated with the targeted image. In various embodiments, method 300 proceeds to block 314 after the execution of the method step in block 312.

At block 314, method 300 generates a new watch-list entry and stores the new watch-list entry in the watch-list module 125.

Figure 3B:
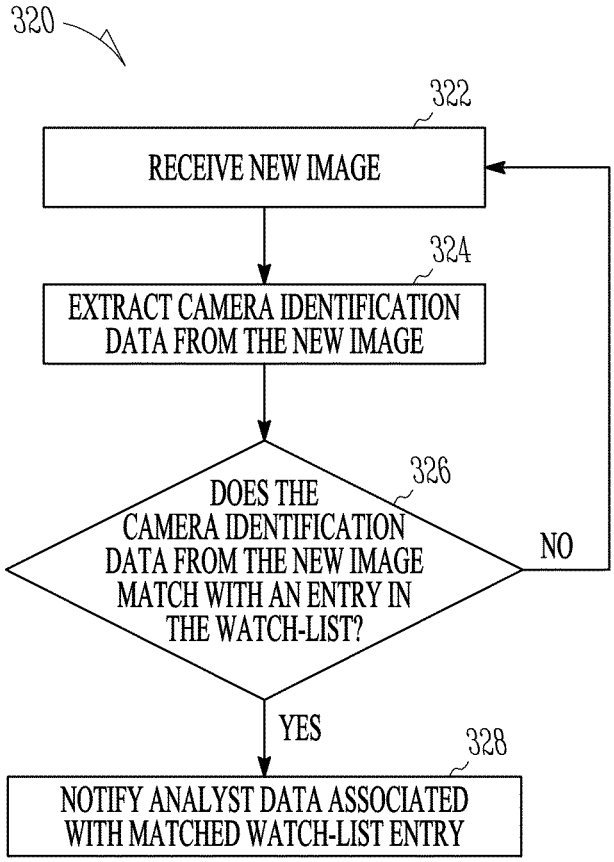
FIG. 3B is a flow chart of a method to notify an analyst regarding a received image matching a watch-list entry, according to some embodiments of the invention.

FIG. 3B is a flow chart of a method 320 to notify an analyst regarding a received image matching a watch-list entry, according to some embodiments of the invention.

At block 322, method 320 includes receiving a new image at the camera identification module 115 (as shown in FIG. 1B). Method 320 proceeds to block 324 after receiving a new image in block 322.

At block 324, method 320 includes extracting camera identification data from the new image. In various embodiments, method 300 proceeds to block 326 after the execution of the method step in block 324.

At block 326, method 320 includes determining if the camera identification data from the new image matches with an entry in the watch-list stored in watch-list module 125. In various embodiments, if the camera identification data from the new image does not match with an entry in the watch-list, then method 320 proceeds to block 322. In various embodiments, if the camera identification data from the new image matches with an entry in the watch-list, then the method 320 proceeds to block 328.

At block 328, method 320 includes notifying the analyst about information associated with the new image and the matched watch-list entry. In some embodiments, notifying the analyst includes generating an alert such that the analyst is notified using an email. In some embodiments, the alert can be provided by generating a pop-up window at a workstation. In some embodiments, the generated alert includes data regarding the location, specification, and ownership of the camera associated with the matched images.

Figure 4:
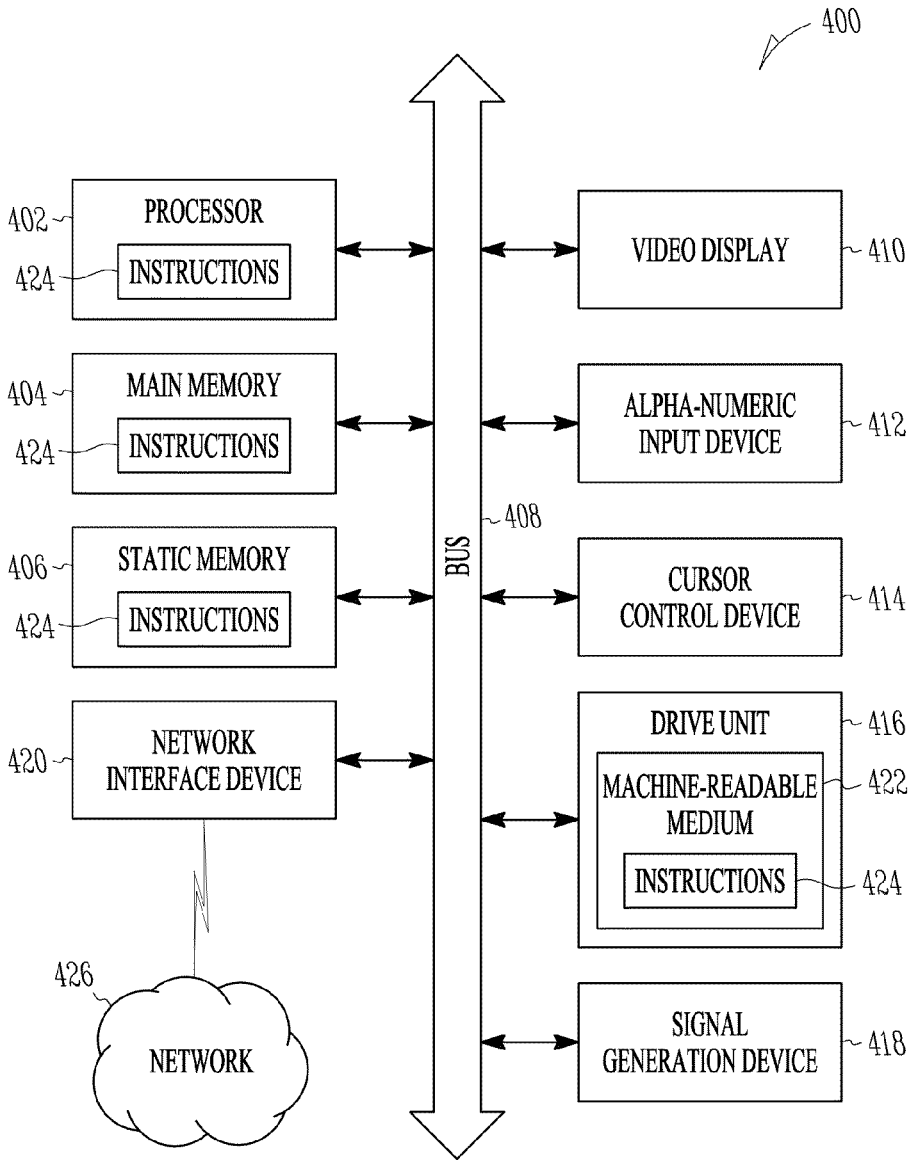
FIG. 4 is a block diagram illustrating a machine in the example form of a computer system having a set of sequence of instructions used for analyzing images and notifying an analyst when a received image matches a watch-list entry, according to some embodiments of the invention.

FIG. 4 is a block diagram illustrating a machine in the example form of a computer system 400 having a set of sequence of instructions used for analyzing images and notifying an analyst when a received image matches a watch-list entry, according to some embodiments of the invention.

In some embodiments, the computer system 400 described herein may be a server computer, a client computer, a personal computer (PC), a tablet PC, a set-top box (STB), a Personal Digital Assistant (PDA), a cellular telephone, a web appliance, a network router, switch or bridge, or any machine capable of executing a set of instructions that specify actions to be taken by that machine. Further, while only a single machine is illustrated, the term "machine" shall also be taken to include any collection of machines that individually or jointly execute a set of instructions to perform any one or more of the methodologies discussed herein.

The example computer system 400 includes a processor 402 (e.g., a central processing unit (CPU) a graphics processing unit (GPU) or both), a main memory 404 and a static memory 406, which communicate with each other via a bus 408. The computer system 400 may further include a video display unit 410 (e.g., a liquid crystal display (LCD) or a cathode ray tube (CRT)). The computer system 400 also includes an alphanumeric input device 412 (e.g., a keyboard), a cursor control device 414 (e.g., a mouse), a disk drive unit 416, a signal generation device 418 (e.g., a camera sensor) and a network interface device 420. The disk drive unit 416 includes a computer-readable medium 422 on which is stored one or more sets of instructions (e.g., software 424) embodying any one or more of the methodologies or functions described herein for methods 300 and 320. In some embodiments, the computer readable medium 422 is encoded with instructions, wherein the instructions when executed includes analyzing image frames at the image analysis workstation 110, followed by generating a fingerprint for the received image frames based on sensor imperfections and/or image characteristics. In some embodiments, the computer readable medium 422 is encoded with instructions, which when executed includes determining if a received image frame is being targeted for notification to an analyst. In some embodiments, the computer readable medium 422 is encoded with instructions, which when executed notifies at least one analyst information associated with a received image when it is found to have matching fingerprint to that of another image listed in a stored watch-list.

The software 424 may also reside, completely or at least partially, within the main memory 404 and/or within the processor 402 during execution thereof by the computer system 400, the main memory 404 and the processor 402 also constituting machine-readable media. The software 424 may further be transmitted or received over a network 426 via the network interface device 420.

While the machine-readable medium 422 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that cause the machine to perform any one or more of the methodologies of the present invention. The term "machine-readable medium" shall accordingly be taken to include, but not be limited to, solid-state memories, optical and magnetic media.

Figure 5:
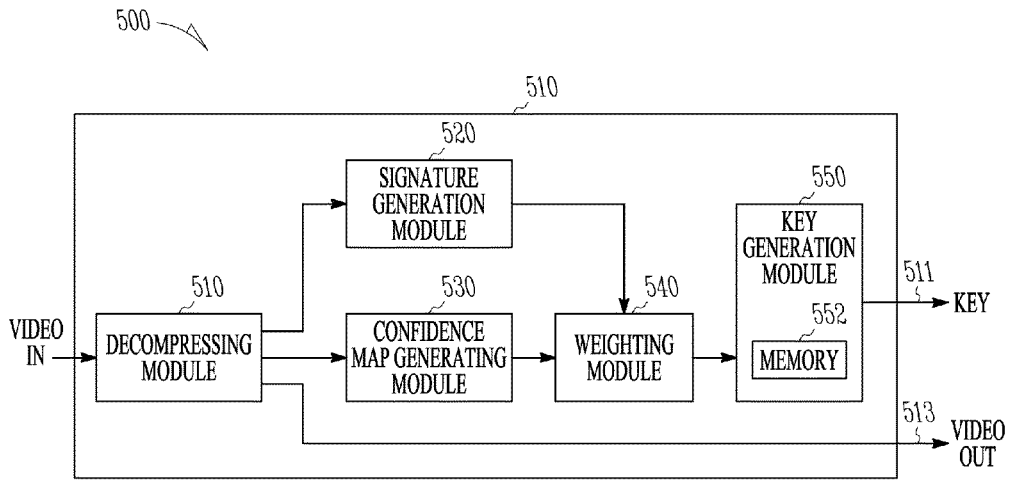
FIG. 5 is a block diagram of a video fingerprinting apparatus, according to an example embodiment.

FIG. 5 is a block diagram of a video fingerprinting apparatus, according to an example embodiment. In some embodiments, fingerprinting apparatus includes a decompressing module 5210, a signature generation module 5220, a confidence map generating module 5230, a weighting module 5240, and a key generation module 5250 having a memory 5252. In some embodiments, the incoming video frames are provided to decompressing module 5210 that is coupled to the signature module 5220 and confidence map generating module 5230 and link 5113 that provides video out. In some embodiments, the signature generation module 5220 and confidence map generating module 5230 are coupled to the weighting module 5240 that is coupled to the key generation module 5250.

In some embodiments, the fingerprinting module 5110 receives an input signal "VIDEO IN" and provides two outputs, a generated "KEY" on link 5111 and "VIDEO OUT" on link 5113. In some embodiments, the video signal "VIDEO IN" includes video frames and related meta-data, which are received and decompressed in decompressing module 5210. In some embodiments, the metadata would include a gain and a flag indicating whether or not the frame is an intra-frame in the compressed stream. Because intra-frames are preserved at a higher quality in the compressed video stream, as is known to those skilled in the art, the confidence in the signatures extracted from them will be higher.

In some embodiments, the signature module 5220 is configured to generate a signature representative of camera sensor imperfections. The signature generated by signature module 5220 is received by the weighting module 5240. In some embodiments, the confidence map generating module 5230 is configured to generate a confidence map. In some embodiments, the confidence map is an array which is the same size as the image. Each entry in the confidence map indicates the relative confidence in the accuracy of the signature generation at the corresponding pixel location in the image. The relative confidence level can be represented within a scale having a range "0" to "1", with "0" indicating no confidence and "1" indicating very high confidence. In some embodiments, the confidence map generation module 5230 is standardized using some controlled data to find an image metric that correlates with the accuracy of the output of the signature generation module 5220. In some embodiments, the metric will be some combination of the following: magnitude of the image gradient, output of an edge detector, artifacts introduced by compression (JPEG/MPEG blocking), a global factor (i.e. indicative of the confidence in the entire frame) related to the gain, a global factor related to compression (whether the frame is an intra-frame). As is known to those skilled in the art, gradient magnitude is a simple measure of the degree of change in an image's intensity in a local neighborhood. Edge detectors, of which there are many forms, produce an output that indicates the presence of sharp changes in intensity in an image, as would be found e.g. at the boundary of an object. The gain is the amplification of the charge accumulated on the sensor as it is read out and converted to a digital representation; higher gain values will amplify some of the sensor imperfections that may form the basis for the signature, making the signature stronger in the high gain frames. Because intra-frames are preserved at a higher quality in the compressed video stream, they will be relatively more useful in signature extraction.

In some embodiments, the weighting module 5240 receives the signature generated by the signature generation module 5220 and performs a weighting function using the confidence map received from the confidence map generating module 5230. The weighted signature from the weighting module 5240 is received by the key generation module 5250 which in turn generates a key representing the sensor imperfections of any of the cameras.

Figure 6:
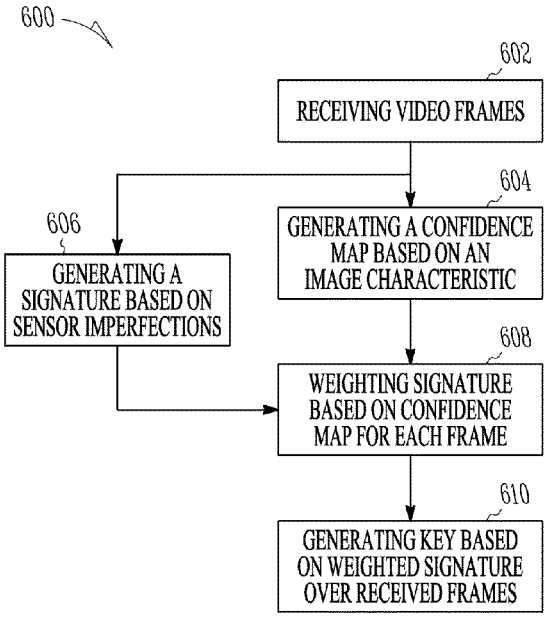
FIG. 6 is a flowchart illustrating a method of providing camera sensor fingerprinting for incoming video data in closed circuit surveillance systems, according to an example embodiment.

FIG. 6 is a flowchart illustrating a method 6300 of providing camera sensor fingerprinting for incoming video data in closed circuit surveillance systems, according to an example embodiment. In some embodiments, method 6300.

At 6302, method 6300 includes receiving video frames at the video fingerprinting apparatus 112, according to some embodiments. In some embodiments, each of the cameras 104, 106 and 108 are connected to the fingerprinting apparatus in order to characterize the camera before being deployed in the closed circuit video surveillance system. In one embodiment, the camera is focused on a uniformly colored, plain surface while the fingerprinting apparatus 112 generates a key. The uniformly colored, plain surface is provided so as to have a relatively same input signal to be received at each of pixels in the camera sensor thereby allowing the fingerprinting apparatus to determine more accurately a key for the camera sensor. In some embodiments, a uniformly textured surface is provided as the image input to the cameras 104, 106 and 108 during the key generation process. In some embodiments, as each of the cameras are characterized in succession, their respective keys are stored in the key database 112. Upon loading all the keys in the key database 112, the cameras are deployed in the closed circuit surveillance system.

At 6304, method 6300 includes generating a confidence map based on an image characteristic received from a camera sensor. In some embodiments, the confidence map generation is performed using an edge detection algorithm which determines the various confidence levels for the values of individual pixels of the camera sensor. In some embodiments, generating a confidence map based on image characteristics associated with each video frame includes generating a confidence map that includes an array of elements, wherein each element represents a confidence value for a corresponding pixel of the video frame. In some embodiments, generating the confidence map includes generating a confidence map based on edge detection on images carried by the video frames. In some embodiments, generating the confidence map includes generating a confidence map based on texture detection on images carried by the video frames. In some embodiments, generating the confidence map for a frame includes providing a global scale factor based on an estimate of the gain used in the conversion of charge in the camera sensor to a digital representation of that frame. In some embodiments, generating the confidence map for a frame includes a providing a global scale factor based on the level of compression applied to that frame.

At 6306, method 6300 includes generating a signature based on sensor imperfections. In some embodiments, the components of the signature generated for a given camera includes dark noise, photo-response non-uniformity, readout smear, locations of defective pixels, the pattern of the sensor's color filter array (for color sensors), etc. In some embodiments, generating a signature includes generating a partial signature including an array of components, wherein each component in the array represents the sensitivity of the corresponding pixel. In some embodiments, each component in the array represents an indication of whether the corresponding pixel's sensitivity is either inside or outside a tolerance range.

At 6308, method 6300 includes weighting the generated signature based on the confidence map generated for each video frame received at block 6302. In some embodiments, method 6300 includes weighting the components of a partial signature derived at 6306 using the corresponding elements in the confidence map generated for each of the plurality of video frames. In some embodiments, an average value which is generated from a number of frames is used for weighting the generated signature.

At 6310, method 6300 includes generating key based on the weighted signature over received video frames. In some embodiments, method 6300 includes comparing the generated key for a given image from a camera with stored keys in the key database 112. In some embodiments, if a particular key generated for an image frame does not match with any of the stored keys in key database 112, then the associated video frames are determined not to be from one of the cameras provided in the closed circuit surveillance system. In some embodiments, the key comparison task is performed in a correlating module 114. In some embodiments, the correlating module 114 performs a cross-correlation between two signatures or keys. In some embodiments, the correlating module 114 determines if the cross-correlation between two signatures or keys shows a high correlation or a low correlation. In some embodiments, a video filtering module 116 receives a signal from the correlating module 114 identifying whether or not a particular image frame is produced by one of the cameras in the surveillance system.

The above-described steps can be implemented using standard programming techniques. The novelty of the above-described embodiment lies not in the specific programming techniques but in the use of the methods described to achieve the described results. Software programming code which embodies the present application is typically stored in permanent storage. In a client/server environment, such software programming code may be stored in storage associated with a server. The software programming code may be embodied on any of a variety of known media for use with a data processing system, such as a diskette, or hard drive, or CD ROM. The code may be distributed on such media, or may be distributed to users from the memory or storage of one computer system over a network of some type to other computer systems for use by users of such other systems. The techniques and methods for embodying software program code on physical media and/or distributing software code via networks are well known and will not be further discussed herein.

It will be understood that each element of the illustrations, and combinations of elements in the illustrations, can be implemented by general and/or special purpose hardware-based systems that perform the specified functions or steps, or by combinations of general and/or special-purpose hardware and computer instructions.

These program instructions may be provided to a processor to produce a machine, such that the instructions that execute on the processor create means for implementing the functions specified in the illustrations. The computer program instructions may be executed by a processor to cause a series of operational steps to be performed by the processor to produce a computer-implemented process such that the instructions that execute on the processor provide steps for implementing the functions specified in the illustrations. Accordingly, the figures support combinations of means for performing the specified functions, combinations of steps for performing the specified functions, and program instruction means for performing the specified functions.

While there has been described herein the principles of the application, it is to be understood by those skilled in the art that this description is made only by way of example and not as a limitation to the scope of the application. Accordingly, it is intended by the appended claims, to cover all modifications of the application, which fall within the true spirit, and scope of the invention.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A method, comprising:

receiving a first camera-recorded image frame from at least one of a plurality of public repositories;

receiving a second camera-recorded image frame from at least one of the plurality of public repositories, wherein the second camera-recorded image frame includes content different from the first camera-recorded image frame;

using the first and second camera-recorded image frames, extracting a camera fingerprint that is associated with a pixel to pixel comparison of the first camera-recorded image frame to the second camera-recorded image frame and is uniquely representative of a camera imperfection associated with at least one semiconductor imperfection of a pixel of a camera sensor of a camera that recorded each of the first camera-recorded image frame and the second camera-recorded image frame, the camera fingerprint being undamaged by alteration;

storing the camera fingerprint in a directory;

receiving a new camera-recorded image frame from one of the plurality of public repositories, wherein the new camera-recorded image frame includes new content differing from the content of the first camera-recorded image frame and the second camera-recorded image frame;

extracting a new camera fingerprint corresponding to the new camera-recorded image frame;

comparing the new camera fingerprint to the stored camera fingerprint; and generating an alert if a match is determined between the new camera fingerprint and the stored camera fingerprint in the directory, the alert generated in response to the new camera fingerprint matching the stored camera fingerprint above a variable threshold.

2. The method of claim 1, wherein generating an alert includes providing an email notification to an analyst.

3. The method of claim 1, wherein generating an alert includes providing notification through a pop-up window at a workstation.

4. The method of claim 1, wherein an analyst determines whether the camera fingerprint corresponding to a particular image frame is to be added to the directory.

5. The method of claim 1, wherein an automated process determines whether the camera fingerprint corresponding to a particular image frame is to be added to the directory.

6. The method of claim 1, wherein the image frames include video images from a video camera.

7. The method of claim 1, wherein the image frames include stationary images from a digital camera.

8. The method of claim 1, wherein the generated alert includes providing data regarding the location and specification of the camera associated with the matched camera fingerprints.

9. A computer-usable storage device having computer readable instructions stored thereon for execution by a processor to perform a method comprising:

receiving one or more camera-recorded image frames from a plurality of public repositories;

for each of the one or more camera-recorded image frames, extracting a reference camera identification data that is associated with a pixel to pixel comparison associated with at least one semiconductor imperfection of a pixel of a camera sensor of a camera that recorded the camera-recorded image frame, corresponding to each of the one or more camera-recorded image frames, which is uniquely representative of a camera imperfection, the reference camera identification data being undamaged by alteration;

storing each of the reference camera identification data corresponding to the one or more image frames in a watch-list;

receiving a new camera-recorded image frame from one of the plurality of public repositories, wherein the new camera-recorded image includes new content differing from the content of the one or more camera-recorded image frames;

extracting new camera identification data corresponding to the new camera-recorded image frame;

comparing the new camera identification data to each of the stored reference camera identification data; and generating an alert if a match is determined between the new camera identification data and the stored reference camera identification data, the alert generated in response to the new camera fingerprint matching the stored camera fingerprint above a variable threshold.

10. The computer-usable storage device of claim 9, wherein generating an alert includes providing an email notification to an analyst.

11. The computer-usable storage device of claim 9, wherein generating an alert includes providing notification through a pop-up window at a workstation.

12. The computer-usable storage device of claim 9 comprises:

determining whether or not the camera identification data corresponding to a particular image/video is to be added to the watch list.

13. The computer-usable storage device of claim 9, wherein generating the alert includes generating data regarding the location and ownership of the matched camera identification data.

14. A system, comprising:

a camera identification module to receive a plurality of camera-recorded image frames containing different content and, for each camera-recorded image frame containing different content, generating a camera fingerprint that is associated with a pixel to pixel comparison of the camera-recorded image frame and is uniquely representative of a camera imperfection associated with at least one semiconductor imperfection of a pixel of a camera sensor of a camera that recorded the camera-recorded image frame, the camera fingerprint being undamaged by alteration and at least one of the plurality of camera-recorded image frames being received from a public repository;

a camera-recorded image watch-list module to store a plurality of camera signature entries including camera identification data corresponding to at least one camera;

a camera-recorded image analysis module coupled to the camera identification module and the camera-recorded image watch-list module, the camera-recorded image analysis module to determine a match between the camera fingerprint and at least one of the plurality of camera signature entries; and an alert notifier module coupled to the camera-recorded image analysis module, the alert notifier module to send a notification to an analyst if a match is determined between the camera fingerprint and at least one of the plurality of signature entries, the notification sent in response to the new camera fingerprint matching the stored camera fingerprint above a variable threshold.

15. The system of claim 14, wherein the camera identification module is configured to generate the camera fingerprint based on image characteristics associated with each image frame.

16. The system of claim 14, wherein the camera identification module is configured to generate the camera fingerprint based on camera sensor pixel imperfections associated with a camera generating the plurality of image frames.

17. The system of claim 16, wherein the camera identification module is configured to generate the camera fingerprint using a weighting function over a plurality of image frames, the weighting function is generated based on a confidence map for each frame.

18. The system of claim 17, wherein the confidence map is based on edge detection.

19. The system of claim 17, wherein the confidence map is based on texture detection.

20. The system of claim 14, wherein the plurality of image frames includes one or more video frames.

* * * * *